US011044940B2

(12) United States Patent
Senftleben et al.

(10) Patent No.: US 11,044,940 B2
(45) Date of Patent: Jun. 29, 2021

(54) PACKAGE FOR ACCOMMODATING PRODUCTS

(71) Applicant: Fontem Holdings 1 B.V., Amsterdam (NL)

(72) Inventors: Sebastian Senftleben, Hamburg (DE); Stefan Biel, Hamburg (DE); Fiona Collins, Hamburg (DE); Reinier Halbertsma, Amsterdam (NL)

(73) Assignee: Fontem Holdings 1 B.V., Amsterdam (NL)

( * ) Notice: Subject to any disclaimer, the term of this patent is extended or adjusted under 35 U.S.C. 154(b) by 0 days.

(21) Appl. No.: 15/593,857

(22) Filed: May 12, 2017

(65) Prior Publication Data

US 2017/0325500 A1 Nov. 16, 2017

(30) Foreign Application Priority Data

May 13, 2016 (EP) ..... 16169567

(51) Int. Cl.

| | |
|---|---|
| ***A24F 13/14*** | (2006.01) |
| ***B65D 50/04*** | (2006.01) |
| ***B65D 6/06*** | (2006.01) |
| ***A24F 13/02*** | (2006.01) |
| ***A24F 15/12*** | (2006.01) |

(Continued)

(52) U.S. Cl.

CPC ..... *A24F 13/14* (2013.01); *A24F 13/08* (2013.01); *A24F 15/12* (2013.01); *B65D 11/12* (2013.01);

(Continued)

(58) Field of Classification Search

CPC ..... A24F 13/02; A24F 13/08; A24F 13/14; A24F 15/00; A24F 47/00; A24F 47/08; A24F 15/12; B65D 6/06; B65D 11/12; B65D 50/04; B65D 50/046; B65D 85/10; B65D 85/1054; B65D 85/1081; B65D 2215/02

(Continued)

(56) References Cited

U.S. PATENT DOCUMENTS 536,923 A 4/1895 Dion
2,541,173 A * 2/1951 Moore ..... B65D 5/38 229/125.125

(Continued)

FOREIGN PATENT DOCUMENTS

CN 201109522 Y 9/2008
CN 205169130 U 4/2016

(Continued)

OTHER PUBLICATIONS

European Patent Office; Extended European Search Report issued in counterpart application No. EP16169567.1. dated Nov. 7, 2016.

*Primary Examiner* — Bryon P Gehman
(74) *Attorney, Agent, or Firm* — Dykema Gossett PLLC

(57) ABSTRACT

The invention relates to a package for accommodating products. The package comprises an inner tray, a cover and a removable sleeve. The inner tray comprises a plurality of protrusions. The package comprises a plurality of cavities and protrusions, wherein the respective cavities interlock with the protrusions. The package comprises further a plurality of unlocking elements adapted such that in the coupled state of the package, the respective cavity unlocks from the respective protrusion when a pressure is applied to the respective unlocking element.

27 Claims, 5 Drawing Sheets

(51) Int. Cl.
*B65D 85/10* (2006.01)
*A24F 13/08* (2006.01)
*A24F 47/00* (2020.01)

(52) U.S. Cl.
CPC ..... *B65D 50/046* (2013.01); *B65D 85/1054* (2013.01); *B65D 85/1081* (2013.01); *A24F 13/02* (2013.01); *A24F 47/008* (2013.01); *B65D 85/10* (2013.01); *B65D 2215/02* (2013.01)

(58) Field of Classification Search
USPC ..... 220/359.1–359.4; 229/125.125
See application file for complete search history.

(56) References Cited

U.S. PATENT DOCUMENTS 3,487,915 A * 1/1970 Scott ..... B65D 75/38 206/525
3,684,084 A * 8/1972 Kanzelberger ..... B65D 5/38 229/125.125
3,759,720 A * 9/1973 Young ..... B65D 77/0433 229/122
4,007,828 A * 2/1977 Mayled ..... B65D 11/12 206/1.5
5,269,404 A * 12/1993 Wischusen, III ..... B65D 5/38 229/123.1
9,326,580 B2 * 5/2016 Provost ..... B65G 11/12
9,926,125 B2 * 3/2018 Whitehurst ..... B65D 5/38
2007/0284277 A1 12/2007 Gnepper
2011/0139647 A1 * 6/2011 Petricca ..... A45D 27/225 206/354

FOREIGN PATENT DOCUMENTS

CN 205554875 U 9/2016
GB 2374862 A 10/2002
WO 2005049437 A1 6/2005
WO 2010058237 A1 5/2010

* cited by examiner

PACKAGE FOR ACCOMMODATING PRODUCTS

CROSS-REFERENCE TO RELATED APPLICATION

This application claims priority to European patent application No. 16169567.1, filed May 13, 2016. This European application is hereby incorporated by reference as though fully set forth herein.

BACKGROUND a. Field

The present invention relates generally to a package for accommodating products such as electronic smoking devices and parts thereof.

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

A variety of products should not be easily accessible for unauthorized person such as children. Thus, packages or containers in which such products are accommodated require a non-trivial opening mechanism, which cannot be easily opened by children. On the other hand, the integration of such an opening mechanism should not interfere with advertising concepts or reduce the optical appearance of the package.

BRIEF SUMMARY

In accordance with one aspect of the present invention there is provided a package adapted for accommodating products. The package comprises an inner tray comprising at least one recess formed at an upper side of the inner tray and being adapted for accommodating a product, the upper side of the inner tray having a first portion and a second portion adjoining the first portion. The package further comprises a cover adapted for covering at least the first portion, wherein the cover is movable between an open state of the package in which the at least one recess is accessible to a user and a closed state of the package in which the at least one recess is inaccessible to a user. Furthermore a removable sleeve adapted to be fixed on the inner tray in the closed state and adapted to be removed from the inner tray in the open state, wherein the sleeve is movable between a coupled state of the package in which the cover is fixed to the inner tray and an uncoupled state of the package in which the cover can move in relation to the inner tray. The package further comprises a plurality of pairs of cavities and protrusions, wherein one among the cavities and the protrusions is formed in the second portion of the inner tray and the other one among the cavities and the protrusions is formed on an inner surface of the removable sleeve, wherein the respective cavity interlocks with the respective protrusion in the coupled state of the package, wherein each of the pairs comprise an unlocking element adapted such that, in the coupled state of the package, the respective cavity unlocks from the respective protrusion when a pressure is applied to the respective unlocking element.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

Figure 1:
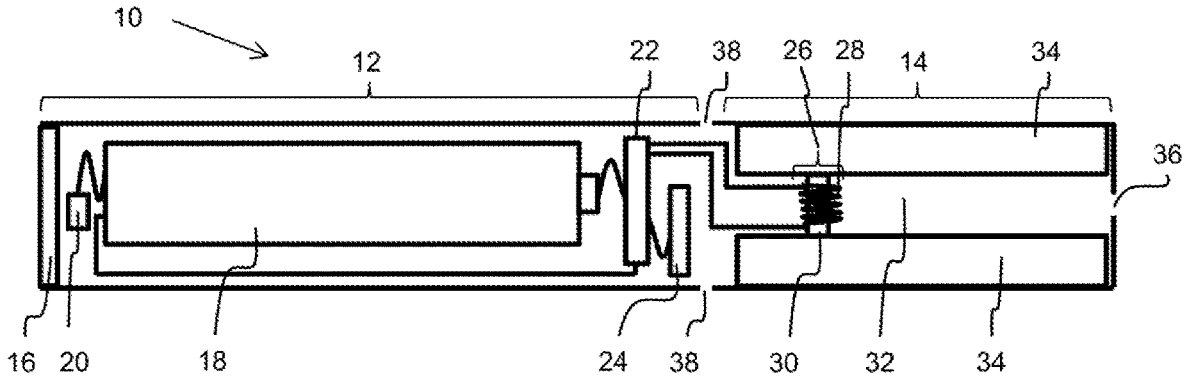
FIG. 1 is a schematic cross-sectional illustration of an exemplary e-cigarette.

While various embodiments discussed herein are amenable to modifications and alternative forms, aspects thereof have been shown by way of example in the drawings and will be described in detail. It should be understood, however, that the intention is not to limit the disclosure to the particular embodiments described. On the contrary, the intention is to cover all modifications, equivalents, and alternatives falling within the scope of the disclosure including aspects defined in the claims.

DESCRIPTION OF THE PREFERRED EMBODIMENTS

The disclosure and the various features and advantageous details thereof are explained more fully with reference to the non-limiting embodiments and examples that are described and/or illustrated in the accompanying drawings and detailed in the following.

Throughout the following, a package for accommodating products such as electronic smoking devices and parts thereof will be exemplarily described with reference to an e-cigarette. E-cigarettes and parts thereof such as atomizers, cartomizers, batteries and liquid reservoirs are deemed to be product to be accommodating in a package in accordance with the present invention. In FIG. 1, an e-cigarette and parts thereof are explained in more detail.

As is shown in FIG. 1, an e-cigarette 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a power supply portion 12 and an atomizer/liquid reservoir portion 14. Together the power supply portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 181 mm, and diameters from 5 to 28 mm.

The power supply portion 12 and atomizer/liquid reservoir portion 14 are typically made of metal, e.g. steel or aluminum, or of hardwearing plastic and act together with the end cap 16 to provide a housing to contain the components of the e-cigarette 10. The power supply portion 12 and an atomizer/liquid reservoir portion 14 may be configured to fit together by a friction push fit, a snap fit, or a bayonet attachment, magnetic fit, or screw threads. The end cap 16 is provided at the front end of the power supply portion 12. The end cap 16 may be made from translucent plastic or other translucent material to allow a light-emitting diode (LED) 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the power supply portion 12 and the atomizer/liquid reservoir portion 14. FIG. 1 shows a pair of air inlets 38 provided at the intersection between the power supply portion 12 and the atomizer/liquid reservoir portion 14.

A power supply, preferably a battery 18, an LED 20, control electronics 22 and optionally an airflow sensor 24 are provided within the cylindrical hollow tube power supply portion 12. The battery 18 is electrically connected to the control electronics 22, which are electrically connected to the LED 20 and the airflow sensor 24. In this example the LED 20 is at the front end of the power supply portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending across a central passage 32 of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or may be formed in an end cap.

In use, a user sucks on the e-cigarette 10. This causes air to be drawn into the e-cigarette 10 via one or more air inlets, such as air inlets 38, and to be drawn through the central passage 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the central passage 32. As the user continues to suck on the e-cigarette 10, this aerosol is drawn through the central passage 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some e-cigarette are intended to be disposable and the electric power in the battery 18 is intended to be sufficient to vaporize the liquid contained within the liquid reservoir 34, after which the e-cigarette 10 is thrown away. In other embodiments the battery 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the e-cigarette 10 is detachable from the power supply portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The new liquid reservoir 34 may be in the form of a cartridge having a central passage 32 through which a user inhales aerosol. In other embodiments, aerosol may flow around the exterior of the cartridge 32 to an air inhalation port 36.

Of course, in addition to the above description of the structure and function of a typical e-cigarette 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Figure 2:
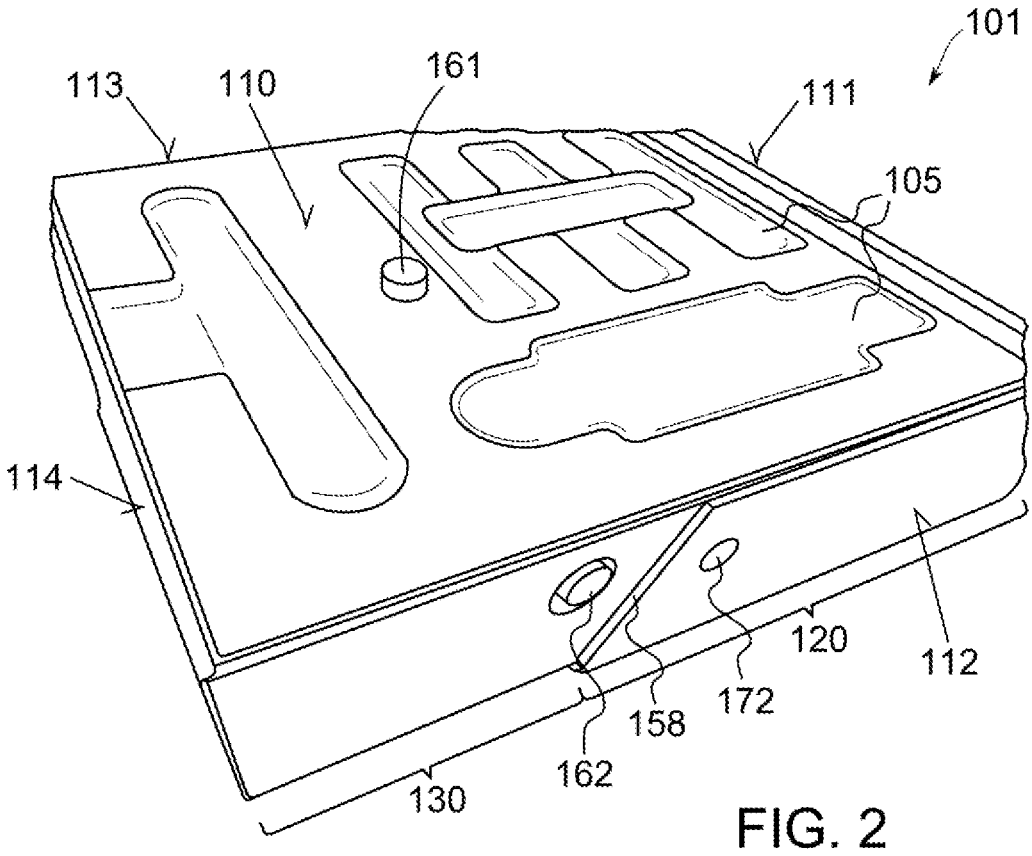
FIG. 2 is a schematic perspective view of an inner tray according to an embodiment of the present invention.

FIG. 2 shows an inner tray 101 according to an embodiment of the present invention which is part of a package 100 of the present invention.

The inner tray 101 comprises a plurality of recesses 105 formed at an upper side of the inner tray 101 being adapted for accommodating a product. The upper side of the inner tray has a first portion 120 and a second portion 130 adjoining the first portion 120.

Candidates for products to be accommodated in the recesses 105 may be USB charger, knives, scissors, nail scissors, household chemicals etc. Preferred products may be electronic smoking devices and/or electronic smoking device components, for which batteries, vaporizer, cartomizer, liquid reservoirs, mouth pieces, stems of electronic smoking devices etc. are examples.

The inner tray 101 is formed as cuboid but the present invention is not limited to this shape. The inner tray 101 comprises a base panel, a top panel 110 opposite to the base panel, four side panels 111, 112, 113, 114, wherein a first side panel 111 and a fourth side panel 114 are opposite to each other and a second side panel 112 and a third side panel 113 are opposite to each other. The first portion 120 comprises the first side panel 111, parts of the adjacent second side panel 112 and the third side panels 113 and parts of the base panel and the top panel 110. The second portion 130 of the inner tray 101 comprises the complementary parts of the inner tray 101, in particular the fourth side panel 114.

Three protrusions 161, 162 are located on the outer surface of the inner tray 101 in the second portion 130. The first protrusion 161 is located on the top panel 110 of the inner tray 101, the second protrusion 162 is located on the second side panel 112 of the inner tray 101 and the third protrusion (not visible from the perspective of the Figure) is located on the third side panel 113 of the inner tray 101.

The protrusions 161, 162 are constructed to be in the form of protruding hemispheres or flattened hemispheres on the respective panels. The protrusions 161, 162 can be made of metal or alloys but any other suitable material can alternatively be used. The present invention is however not limited to this shape of the protrusions 161, 162.

Furthermore, the inner tray 100 comprises three unlocking elements 171, 172, 173. The first unlocking element 171 is located on the top panel 110, the second unlocking element 172 is located on the second side panel 112 and the third unlocking element 173 (not visible) is located on the third side panel 113, wherein each unlocking element 171, 172, 173 is located in the first portion 120 of the inner tray 101.

The first unlocking element 171 communicates with the first protrusion 161, the second unlocking element 172 communicates with the second protrusion 162 and the third unlocking element 173 communicates with the third protrusion 163. The unlocking elements 171, 172, 173 are not necessarily formed by an additional mechanical architecture, but they are integrated into the respective panels using their response towards applied forces. The side panel layer at the first portion 120, on which the second unlocking element 172 is located, is thicker than the side panel layer of the second portion 130, on which the second protrusion 162 is located, which results in an edge 158 formed between the second protrusion 162 and the corresponding second unlocking element 172, the edge 158 forming a slope (m of approximately m=1). The larger thickness of the layer, in which the unlocking elements 171, 172, 173 are formed, may support the bending or distortion of the side panel under applied pressure. The direction of the applied force may be normal to the respective panels 110, 111, 112.

Thus, if pressure is applied onto the first unlocking element 171, the first protrusion 161 is slightly moved towards the centre of the inner tray 101 due to bending or distortion of the top panel 111 as a response to the applied mechanical pressure. Similarly, if pressure is applied to the second unlocking element 172, the second protrusion 162 slightly moves towards the centre of the inner tray 101 due to bending or distortion of the second side panel 112 and, equivalently, if pressure is applied to the third unlocking element 173, the third protrusion 163 slightly moves towards the centre of the inner tray 101 due to bending or distortion of the third side panel 113. This response of the material in the presence of applied pressure will be employed in the following.

Figure 3:
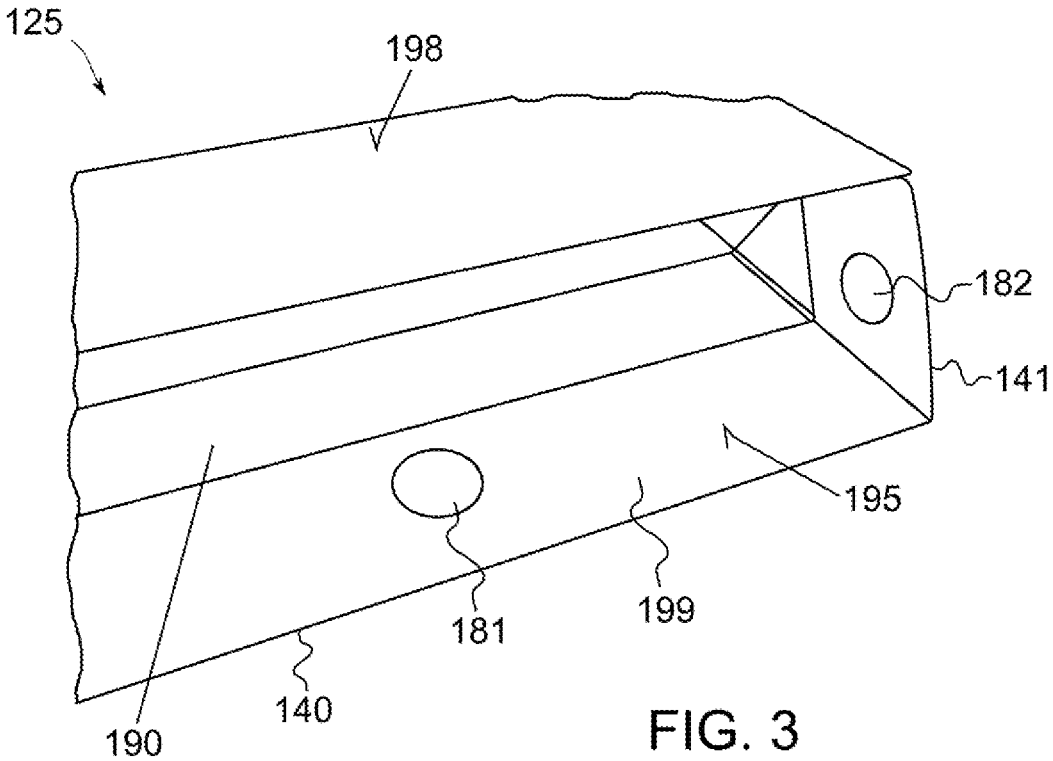
FIG. 3 is a schematic perspective view of a removable sleeve according to an embodiment of the present invention.

FIG. 3 shows a removable sleeve 125 according to an embodiment of the present invention which is part of a package 100 of the present invention.

The removable sleeve 125 is cuboid-shaped with an open side 190 adapted to be fixed on the second portion 130 of the inner tray 101. The present invention is however not limited to this shape of the removable sleeve 125.

The inner surface 195 of the removable sleeve 125 comprises three cavities 181, 182 adapted to receive protrusions 161, 162, 163 of the inner tray 101, from which the first cavity 181 and the second cavity 182 are visible. In particular, the first cavity 181 is located on the inner surface 195 of a top sleeve panel 140 of the removable sleeve 125, a second cavity 182 is located on an inner surface 195 of a second side sleeve panel 142 of the removable sleeve 125 and the third cavity is located on an inner surface 195 of a third side sleeve panel 143 of the removable sleeve 125.

The shape of the cavities 181, 182 has a circular boundary and is essentially invers to the shape of the protrusions 161, 162, 163 adapted to receive the hemispherical or flattened hemispherical protrusions 161, 162, 163. The present invention is however not limited to this shape of the cavities 181, 182. The inner surface 195 comprises an additional layer 199 in which the cavities 181, 182 engage. The material of the additional layer 199 differs from the material of the removable sleeve 125. For example, the additional layer 199 can be a plastic material, whereas the removable sleeve 125 may be a cardboard material. Plastic can be more robust and thus more suitable to form cavities adapted to receive the protrusions of the inner tray 101.

Figure 4:
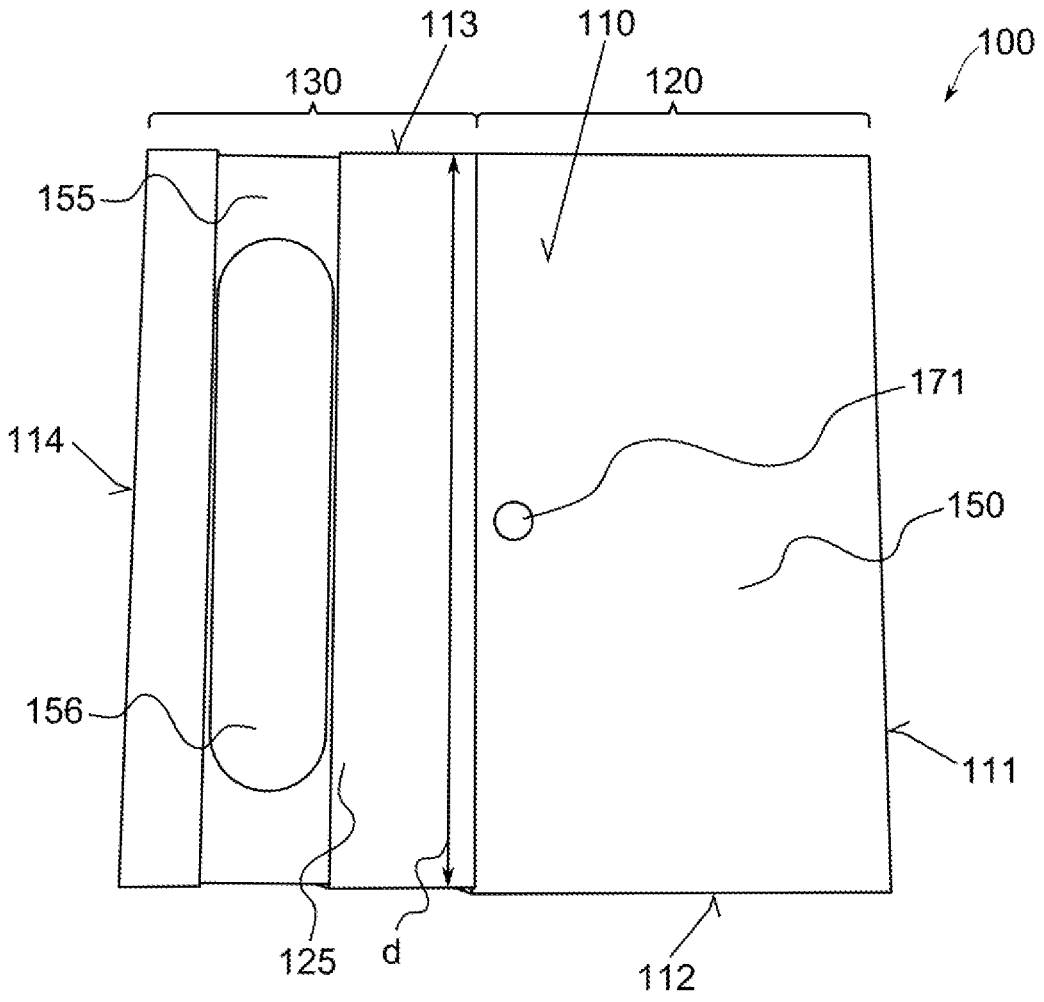
FIG. 4 is a schematic perspective top view of a package according to an embodiment of the present invention in a coupled state.

FIG. 4 shows a package 100 according to an embodiment of the present invention. In FIG. 4, the package 100 is in the coupled state, where the inner tray 150 is entirely covered by the cover 150 and the removable sleeve 125. Coupled state means that the removable sleeve 125 is fixed on the inner tray 101, such that the protrusions 161, 162, 163 of the inner tray 101 interlock with the cavities 181, 182 of the removable sleeve 125. The cover 150 covers at least the first portion 120 of the inner tray, whereas the removable sleeve 125 covers the second portion 130 of the inner tray 101.

In the perspective of FIG. 4, the position of the first unlocking element 171 on the top panel 110 is marked for sake of explanation while the other unlocking elements 172 are not marked. The protrusions 161, 162 of the inner tray 101 are not visible because they are received from the cavities 181, 182 of the inner surface 195 of the removable sleeve 125. Due to the flatness of the outer surface of the removable sleeve 125, the protrusions 161, 162 of the inner tray 101 are invisible from an outer perspective and the package 100 appears flat. This may improve the optical appearance of the package 100. Further, less interruption for branding purposes on the outer surface of the package 100 may be achieved.

To open the package 100, a user has to simultaneously press (i.e. apply pressure onto each of) the plurality of unlocking elements 171, 172, 173 on the inner tray 101 communicating with the protrusions 161, 162, 163. Then, this pressure induces a distortion of the respective panels, where the unlocking elements 171, 172, 173 are located. The top panel 110, the second side panel 112 and the third side panel 113 are bent or distorted at the unlocking elements 171, 172, 173 towards the centre of the inner tray 101. This results in relative motion of the respective protrusion 161, 162, 163 away from the respective cavity 181, 182, of the removable sleeve 125. The cavities 181, 182 of the removable sleeve 125 are thereby released from the protrusions 161, 162 of the inner tray 101 and, upon simultaneous pressure, the removable sleeve 125 can be pulled from the inner tray 101 gaining access to the interior of the package 100. Only if all three protrusions 161, 162, 163 are released from the cavities 181, 182, the removable sleeve 125 can be removed from the inner tray 101.

Without knowledge of this described opening mechanism, the opening of the package 100 may be prevented or at least delayed, in particular it may prevent children from opening the package 100. Furthermore, an advantage may be that the package is fully re-closable, such that it may be used multiple times, which will be demonstrated in the following description.

The positioning of the unlocking elements 171, 172, 173 may have the advantage that all three unlocking elements 171, 172, 173 are located on different axes, which may increase the time required to identify the opening mechanism and may prevent the opening by children with insufficient hand span.

A first force is required to unlock the first cavity 181 from the first protrusion 161, a second force is required to unlock the second cavity 182 from the second protrusion 162 and a third force is required to unlock the third cavity from the third protrusion 163, the second force and the third force being larger than the first force. This reflects the situation that higher forces can be applied on opposing panels 112, 113. The required forces are larger than 0.5 N, 1 N, 1.5 N, 2 N or even larger than 3 N.

A minimum distance between two adjacent unlocking elements (171 and 172, or 171 and 173) is larger than 2 cm, 3 cm, 4 cm or even larger than 5 cm. A maximum distance d between two unlocking elements 172, 173 is larger than 5 cm, 7 cm, 9 cm or even larger than 11 cm. This may guarantee that children do not have a sufficient hand span to open the package 100.

To achieve convenient use for a user, however, the maximum distance d between two unlocking elements 172, 173 may be smaller than 14 cm, 13 cm, 12 cm or even smaller than 11 cm.

The removable sleeve 125 further comprises a first window section 155 transparent for visible light (380 nm to 760 nm). A degree of optical transmission may be greater than 50%, greater than 80% or even greater than 90% (at 555 nm). The cover 150 has a second window section 156 also transparent for visible light. In the coupled state, both window sections 155, 156 have an overlap. Then, the user may see at least parts of the products accommodated in the recesses 105 of the inner tray 101 which may be useful for knowing the potential availability of a stored product.

The first window section 155 is rectangular and the second window section 156 is oval, wherein the second window section 156 is covered by the first window section 155 in the coupled state of the package 100. Alternatively, the first and second window sections 155, 156 can have the same shape and/or size, such that the overlap of the respective windows is maximized in the coupled state.

The inner tray 101 is vacuum-formed (thermoformed). Vacuum-forming is a way of manufacturing plastic components. Plastic sheets are heated to a defined temperature and placed over a mould. A vacuum is then applied to draw the plastic onto the mould. The plastic adopts the shape of the mould and can then be removed. The precision of the resulting shapes of the cavities may be advantageously high.

Figure 5:
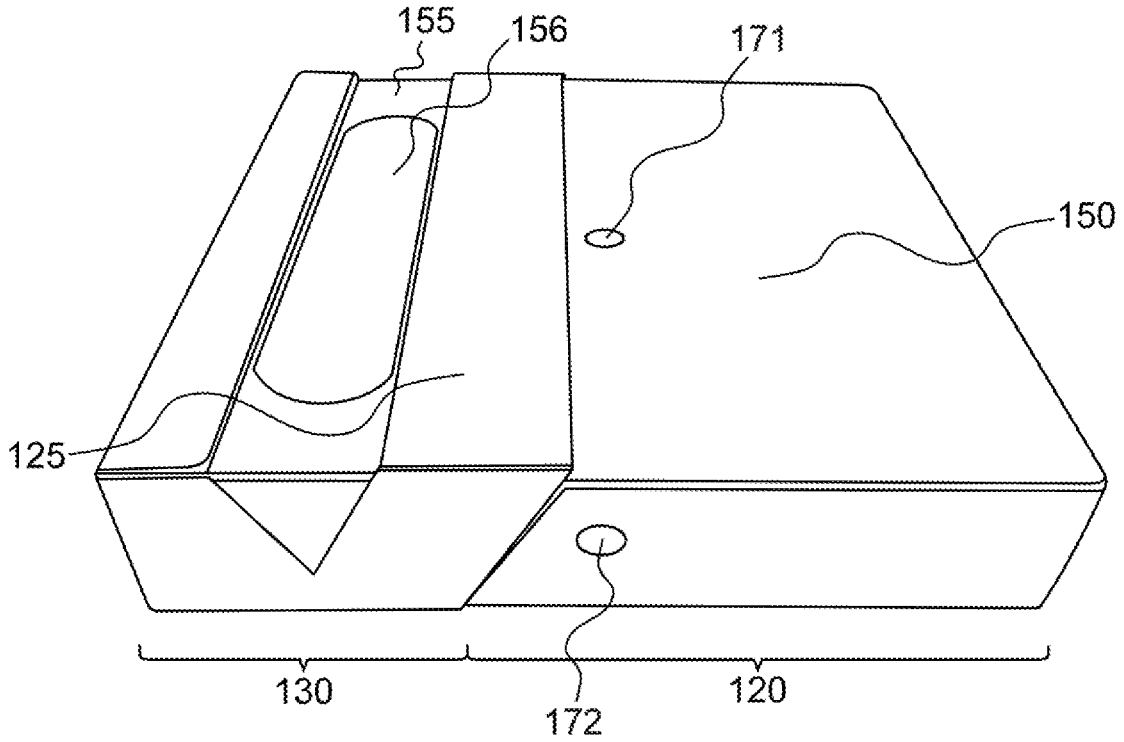
FIG. 5 is a schematic perspective side and top view of a package according to an embodiment of the present invention in a coupled state.

In FIG. 5, a package 100 in a coupled state is shown. In comparison to FIG. 4 the second unlocking element 171 on the first portion 120 is marked (and thereby visible) due to the chosen side view perspective. In order to increase the safety of the package, the position of the unlocking elements 171, 172, 173 is not necessarily marked as demonstrated in FIG. 5. That is, an unauthorized user such as a child will not be able to derive any position information about the unlocking elements which need to be simultaneously pressed for opening the package 100 and for accessing the accommodated products such as an e-cigarette. In other words, the position of the unlocking elements, i.e. the portions where a user has to simultaneously press the package for accessing the accommodated products is not visible from outside and therefore unauthorized users will not be prompted to the opening mechanism.

Figure 6:
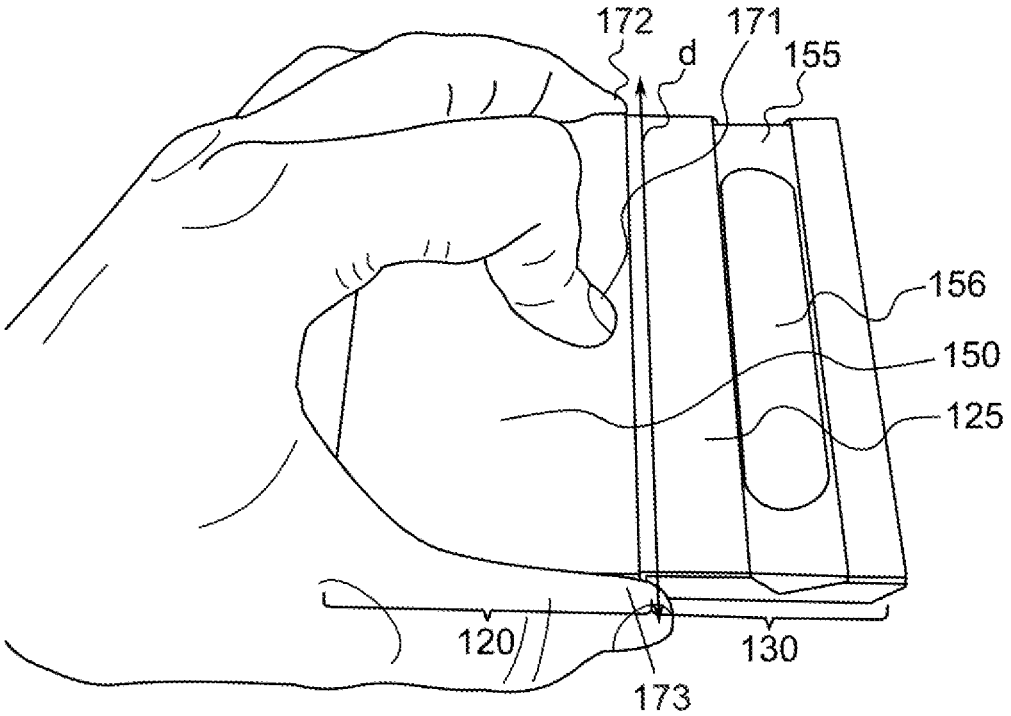
FIG. 6 is a schematic perspective side and top view of a package according to an embodiment of the present invention in a coupled state, where a force is applied to the unlocking elements.

In FIG. 6, a package 100 is shown during the operation of opening the package 100. The figure visualizes the method of opening a package 100 for accommodating products. In the first step a) a package 100 for accommodating products is provided. The exemplary package 100 is identical or similar to the packages 100 as described in the context of the previous figures. The second step comprises b) pressing all unlocking elements 171, 172, 173 simultaneously whilst pulling the removable sleeve 125 in order to remove the removable sleeve 125 from the inner tray 101. This second step is demonstrated by a hand, which simultaneously presses the first 171, the second 172 and the third unlocking element 173 by three fingers. The pulling of the removable sleeve 125 in order to remove the removable sleeve 125 could for example require the usage of the second hand, which is not explicitly demonstrated in here.

Figure 7:
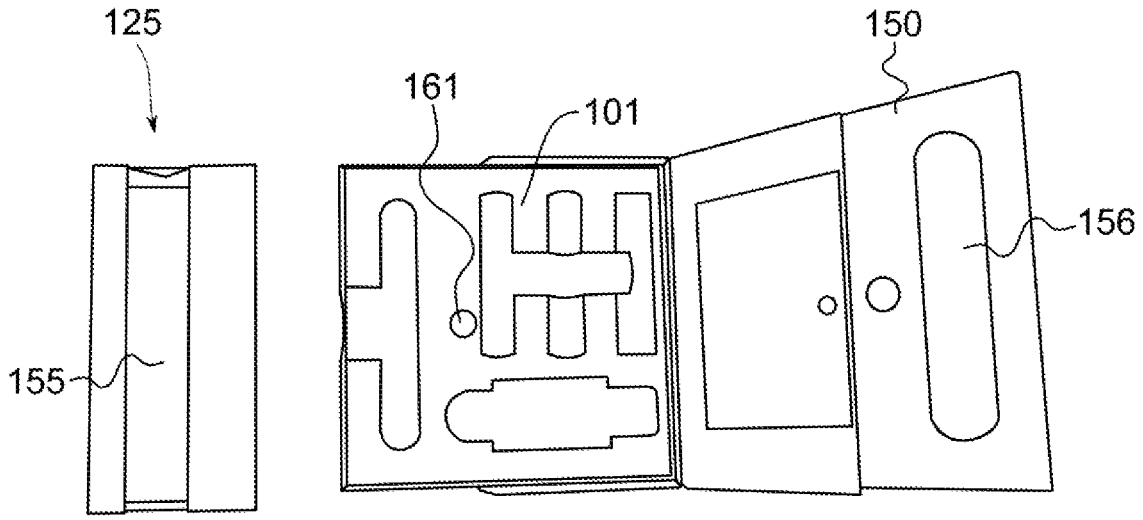
FIG. 7 is a schematic view of a package according to an embodiment of the present invention in a uncoupled and open state.

In FIG. 7, a package 100 in a decoupled state (sleeve removed) and open state (cover opened) from top view perspective is provided. The cover 150 is hinged and opened up. Thus, the third step c) opening the cover to access the accommodated products has been performed which leads to the decoupled state of FIG. 7. The removable sleeve 125 is separated from the inner tray 101 with the cover 150, which has been pulled off whilst performing the second step b). Vice versa, FIG. 7 mimics the starting point (first step) of the method of closing a package 100 for accommodating products. The first step a) refers to providing an inner tray 101 with a cover 150 and a removable sleeve 125, which is described by FIG. 7.

Figure 8:
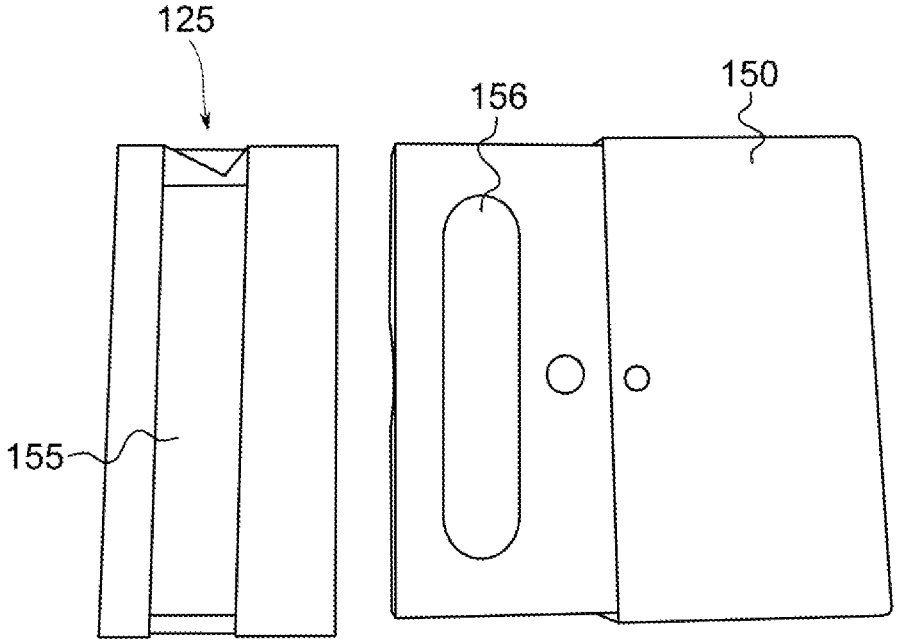
FIG. 8 is a schematic view of a package according to an embodiment of the present invention in an uncoupled and closed state.

In FIG. 8, a package 100 in a decoupled state (sleeve removed) and closed state (cover closed). In the context of the method steps for closing a package 100 adapted to accommodate products, the second step b) closing a cover 150 has been completed, such that the cover 150 covers parts of the inner tray 101. The further step c) pushing the removable sleeve 125 onto the inner tray 101, such that the protrusions 161, 162 of the inner tray 101 are received by the cavities 181, 182 of the removable sleeve 125 is not visualized. Upon performing this step c) would lead back to FIG. 4, of a coupled state if one pushes the removable sleeve 125 onto the inner tray 101 in reverse order to the pulling step of FIG. 6. This demonstrates that the opening mechanism and the closing mechanism are merely the same method steps solely performed in reverse order and reverse actions taken. Thus the opening and closing of the package is bidirectional and the coupled state of the package 100 can be re-established after each usage. Thus, the package 100 can therefore be used persistently multiple times.

In summary, in one aspect of the present invention there is provided a package adapted for accommodating products. The package comprises an inner tray comprising at least one recess formed at an upper side of the inner tray and being adapted for accommodating a product, the upper side of the inner tray having a first portion and a second portion adjoining the first portion. The package further comprises a cover adapted for covering at least the first portion, wherein the cover is movable between an open state of the package in which the at least one recess is accessible to a user and a closed state of the package in which the at least one recess is inaccessible to a user. Furthermore a removable sleeve adapted to be fixed on the inner tray in the closed state and adapted to be removed from the inner tray in the open state, wherein the sleeve is movable between a coupled state of the package in which the cover is fixed to the inner tray and an uncoupled state of the package in which the cover can move in relation to the inner tray. The package further comprises a plurality of pairs of cavities and protrusions, wherein one among the cavities and the protrusions is formed in the second portion of the inner tray and the other one among the cavities and the protrusions is formed on an inner surface of the removable sleeve, wherein the respective cavity interlocks with the respective protrusion in the coupled state of the package, wherein each of the pairs comprise an unlocking element adapted such that, in the coupled state of the package, the respective cavity unlocks from the respective protrusion when a pressure is applied to the respective unlocking element.

Candidates for products may be USB charger, knives, scissors, nail scissors, household chemicals and electronic smoking devices and/or electronic smoking device components. Examples for components are batteries, vaporizer, cartomizer, mouth pieces, stems of electronic smoking devices etc. An advantage may be that without knowledge of the opening mechanism, the opening of the package may be prevented or at least be delayed, in particular, it may prevent children from opening the package. Another advantage may be that the protrusions of the inner tray are not visible for the user or consumer in the closed state of the package since they are received either by the inner surface of the removable sleeve or by the inner tray. This may improve the optical appearance of the package and may render the package more suitable for premium products. Further, less interruption for branding purposes on the surface of the package may be achieved which may as well result in an improved premium feel of the package. Furthermore, an advantage may be that the package is fully re-closable, thus being suitable as multiple use product.

A number of pairs of protrusions and cavities may be three.

A first protrusion may be located on an outer surface of a top panel of the inner tray, a second protrusion may be located on an outer surface of a second side panel of the inner tray and a third protrusion may be located on an outer surface of a third side panel of the inner tray, the second side panel being opposite to the third side panel.

A first cavity may be located on an inner surface of a top sleeve panel of the removable sleeve, a second cavity may be located on an inner surface of a second side sleeve panel of the removable sleeve and a third cavity may be located on an inner surface of a third side sleeve panel of the removable sleeve.

A first unlocking element may be located on the top panel on the first portion of the inner tray, a second unlocking element may be located on the second side panel on the first portion of the inner tray and a third unlocking element may be located on the third side panel on the first portion of the inner tray. An advantage may be that all three unlocking elements are located on different axis, which may increase the time required to identify the opening mechanism and may prevent the opening by children with insufficient hand span.

An inner surface of the removable sleeve may comprise an additional layer, in which the cavities are located.

The material of the additional layer may differ from the material of the removable sleeve. An advantage may be that the material can be chosen to be more robust to prevent damage due to persistent usage.

The removable sleeve may comprise a first window section on the top sleeve panel, the cover may comprise a second window section on the top panel, where the first and the second window section are transparent for visible light, and may have an overlap with each other in the closed state of the package. An advantage may be that at least parts of the products accommodated in the package can be seen by the user or the consumer, which may be useful for advertising or the visibility of the product and one further may identify if the recess is empty or not.

The first and second window sections may have the same shape and/or size. An advantage may be that a maximum overlap and thus a maximal area of transparency may be achieved.

A first force may be required to unlock the first cavity from the first protrusion, a second force may be required to unlock the second cavity from the second protrusion and a third force may be required to unlock the third cavity from the third protrusion, the second force and the third force being larger than the first force. An advantage may be that higher forces can be applied to two opposing panels.

The forces may be larger than 0.5 N, 1 N, 1.5 N, 2 N or larger than 3 N. An advantage may be that children might not have the power to apply the mentioned forces.

A distance between two unlocking elements may be larger than 2 cm, 3 cm, 4 cm or larger than 5 cm. An advantage may be that a child may not be capable of reaching the two unlocking elements with one hand.

A maximum distance between two unlocking elements may be smaller than 5 cm, 8 cm, 11 cm or smaller than 14 cm.

The inner tray may be vacuum-formed (thermoformed). Vacuum-forming may be a way of manufacturing plastic components. Plastic sheets may be heated to a defined temperature and placed over a mould. A vacuum may then be applied to draw the plastic onto the mould. The plastic may adopt the shape of the mould and may then be removed. The precision of the resulting shapes and cavities may be advantageously high.

In another aspect of the invention a method of opening a package for accommodating products is provided comprising the following steps: a) providing a package adapted for accommodating products as described above, b) pressing all unlocking elements simultaneously whilst pulling the removable sleeve in order to remove the removable sleeve from the inner tray, c) opening the cover to access the at least one recess.

In another aspect of the invention a method of closing a package for accommodating products is provided comprising the following steps: a) providing an inner tray with a cover and a removable sleeve as described above, b) closing a cover, c) pushing the removable sleeve onto the inner tray, such that the protrusions of the inner tray are received by the cavities of the removable sleeve.

An advantage may be that the opening mechanism and the closing mechanism may be merely the same method steps solely performed in reverse order. Thus, the opening and closing of the package may be bidirectional and the locked state of the package may be re-established after each usage and the package may therefore be used multiple times.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

Although several embodiments have been described above with a certain degree of particularity, those skilled in the art could make numerous alterations to the disclosed embodiments without departing from the spirit of the present disclosure. It is intended that all matter contained in the above description or shown in the accompanying drawings shall be interpreted as illustrative only and not limiting. Changes in detail or structure may be made without departing from the present teachings. The foregoing description and following claims are intended to cover all such modifications and variations.

Various embodiments are described herein of various apparatuses, systems, and methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," "an embodiment," or the like, means that a particular feature, structure, or characteristic described in connection with the embodiment is included in at least one embodiment. Thus, appearances of the phrases "in various embodiments," "in some embodiments," "in one embodiment," "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

LIST OF REFERENCE SIGNS

10 electronic smoking device
12 power supply portion
14 atomizer/liquid reservoir portion
16 end cap
18 battery
20 light-emitting diode (LED)
22 control electronics
24 airflow sensor
26 atomizer
28 heating coil
30 wick
32 central passage
34 liquid reservoir
36 air inhalation port
38 air inlets
100 package
101 inner tray
105 recess
110 top panel
111 first side panel
112 second side panel
113 third side panel
114 fourth side panel
120 first portion
125 removable sleeve
130 second portion
140 top sleeve panel
141 first side sleeve panel
142 second side sleeve panel
143 third side sleeve panel
150 cover
155 first window section
156 second window section
161 first protrusion
162 second protrusion
163 third protrusion
171 first unlocking element
172 second unlocking element
173 third unlocking element
181 first cavity

182 second cavity
190 open side
195 inner surface
198 outer surface
199 additional layer
d distance

What is claimed is:

1. A package adapted for accommodating products, comprising:

an inner tray comprising at least one recess formed at an upper side of the inner tray and being adapted for accommodating a product, the upper side of the inner tray having a first portion and a second portion adjoining the first portion, a cover adapted for covering at least the first portion, wherein the cover is movable between an open state of the package in which the at least one recess is accessible to a user and a closed state of the package in which the at least one recess is inaccessible to a user, a removable sleeve adapted to be reversibly fixed on the inner tray and to be removed from the inner tray, wherein the sleeve is movable between a coupled state of the package in which the cover is fixed by the sleeve to the inner tray and an uncoupled state of the package in which the cover can move in relation to the inner tray, at least one pair of a cavity and a protrusion, the at least one protrusion is formed in the second portion of the inner tray and the at least one cavity extends into on an inner surface of the removable sleeve, wherein the at least one cavity of the at least one pair interlocks with the at least one protrusion of the at least one pair in the coupled state of the package, wherein the at least one pair further comprises an unlocking element adapted such that, in the coupled state of the package, the at least one cavity of the at least one pair unlocks from the at least one protrusion of the at least one pair when a pressure is applied to the unlocking element.

2. The package according to claim 1, wherein a number of pairs of protrusions and cavities of the at least one pair of the cavity and the protrusion is greater than 2.

3. The package according to claim 1, wherein a number of pairs of protrusions and cavities of the at least one pair of the cavity and the protrusion is 3.

4. The package according claim 1, wherein a first protrusion of the at least one pair of the cavity and the protrusion is located on an outer surface of a top panel of the inner tray, a second protrusion of the at least one pair of the cavity and the protrusion is located on an outer surface of a second side panel of the inner tray and a third protrusion of the at least one pair of the cavity and the protrusion is located on an outer surface of a third side panel of the inner tray, the second side panel being opposite to the third side panel.

5. The package according to claim 4, wherein a first cavity of the at least one pair of the cavity and the protrusion is located on an inner surface of a top sleeve panel of the removable sleeve, a second cavity of the at least one pair of the cavity and the protrusion is located on an inner surface of a second sleeve side panel of the removable sleeve and a third cavity of the at least one pair of the cavity and the protrusion is located on an inner surface of a third sleeve side panel of the removable sleeve.

6. The package according to claim 5, wherein the package is configured and arranged with a first force is required to unlock the first cavity from the first protrusion, a second force is required to unlock the second cavity from the second protrusion and a third force is required to unlock the third cavity from the third protrusion, the second force and the third force being larger than the first force.

7. The package according to claim 4, wherein the unlocking element is located on the top panel on the first portion of the inner tray, a second unlocking element is located on the second side panel on the first portion of the inner tray and a third unlocking element is located on the third side panel on the first portion of the inner tray.

8. The package according to claim 1, wherein the inner surface of the removable sleeve comprises an additional layer in which the at least one cavity is formed.

9. The package according to claim 8, wherein a material of the additional layer differs from a material of an outer surface of the removable sleeve.

10. The package according to claim 1, wherein the removable sleeve comprises a first window section arranged on a top panel of the removable sleeve and the cover comprises a second window section arranged on a top panel of the inner tray, wherein the first window section and the second window section are formed of an optically translucent material, wherein the first window section and the second window section overlap with each other in the closed state of the package.

11. The package according to claim 10, wherein the first window section and second window section have the same shape.

12. The package according to claim 10, wherein the first window section and second window section have the same size.

13. The package according claim 10, wherein the first window section is rectangular and the second window section is oval.

14. The package according claim 10, wherein the first and second window sections are configured and arranged such that the overlap of the respective windows is maximized in the closed state of the package.

15. The package according to claim 1, wherein the package is configured and arranged with a force required to be applied onto the unlocking element for unlocking the cavity of the at least one pair from the respective protrusion of the at least one pair is selected from the group consisting of: 0.5 N, 1 N, 1.5 N, 2 N and larger than 3 N.

16. The package according to claim 1, wherein a minimum distance between the unlocking element and an adjacent unlocking element is selected from the group consisting of: 2 cm, 3 cm, 4 cm and larger than 5 cm.

17. The package according to claim 1, wherein a maximum distance (d) between the unlocking element and an adjacent unlocking element is selected from the group consisting of: 5 cm, 7 cm, 9 cm and larger than 11 cm.

18. The package according to claim 1, wherein the removable sleeve and the cover overlap each other in the closed state of the package.

19. A package adapted for accommodating products, comprising:

an inner tray comprising at least one recess formed at an upper side of the inner tray and being adapted for accommodating a product, the upper side of the inner tray having a first portion and a second portion adjoining the first portion, a cover adapted for covering at least the first portion, wherein the cover is movable between an open state of the package in which the at least one recess is accessible to a user and a closed state of the package in which the at least one recess is inaccessible to a user, a removable sleeve adapted to be reversibly fixed on the inner tray and to be removed from the inner tray, wherein the sleeve is movable between a coupled state of the package in which the cover is fixed by the sleeve to the inner tray and an uncoupled state of the package in which the cover can move in relation to the inner tray, at least one pair of a cavity and a protrusion, wherein the at least one cavity is formed within an inner surface of the inner tray and the at least one protrusion is formed on an inner surface of the removable sleeve, wherein the at least one cavity of the at least one pair interlocks with the at least one protrusion of the at least one pair in the coupled state of the package, wherein the at least one pair further comprises an unlocking element adapted such that, in the coupled state of the package, the at least one cavity of the at least one pair unlocks from the at least one protrusion of the at least one pair when a pressure is applied to the unlocking element.

20. The package according to claim 19, wherein a number of pairs of protrusions and cavities of the at least one pair of the cavity and the protrusion is greater than 2.

21. The package according to claim 19, wherein a number of pairs of protrusions and cavities of the at least one pair of the cavity and the protrusion is 3.

22. The package according to claim 19, wherein the removable sleeve comprises a first window section arranged on a top panel of the removable sleeve and the cover comprises a second window section arranged on a top panel of the inner tray, wherein the first window section and the second window section are formed of an optically translucent material, wherein the first window section and the second window section overlap with each other in the closed state of the package.

23. The package according to claim 22, wherein the first window section and second window section have the same shape.

24. The package according to claim 22, wherein the first window section and second window section have the same size.

25. The package according to claim 19, wherein the package is configured and arranged with a force required to be applied onto the unlocking element for unlocking the cavity of the at least one pair from the respective protrusion of the at least one pair is selected from the group consisting of: 0.5 N, 1 N, 1.5 N, 2 N and larger than 3 N.

26. The package according to claim 19, wherein a minimum distance between the unlocking element and an adjacent unlocking element is selected from the group consisting of: 2 cm, 3 cm, 4 cm and larger than 5 cm.

27. The package according to claim 19, wherein a maximum distance (d) between the unlocking element and an adjacent unlocking element is selected from the group consisting of: 5 cm, 7 cm, 9 cm and larger than 11 cm.

* * * * *